US005103970A

United States Patent [19]

Nielson et al.

[11] Patent Number: 5,103,970

[45] Date of Patent: Apr. 14, 1992

[54] COLLAPSIBLE DISPLAY SYSTEM

[75] Inventors: Edwin D. Nielson; Charles S. Ramsey, both of Wausau, Wis.

[73] Assignee: Fiskars Oy Ab, Helsinki, Finland

[21] Appl. No.: 689,314

[22] Filed: Apr. 22, 1991

[51] Int. Cl.[5] ..... B65D 73/00

[52] U.S. Cl. ..... 206/45.14; 206/45.24; 206/372; 206/482; 211/72

[58] Field of Search ..... 206/44.12, 45.14, 45.24, 206/349, 371, 372, 477–482, 495, 574; 211/44, 57.1, 59.1

[56] References Cited

U.S. PATENT DOCUMENTS

| | | | |
|---|---|---|---|
| 1,391,287 | 9/1921 | Waldes | 206/482 |
| 1,477,241 | 12/1923 | Carson | 206/482 |
| 2,656,917 | 10/1953 | Hollis | 206/482 |
| 2,743,021 | 4/1956 | glenn | 211/72 |
| 3,040,881 | 6/1962 | McNeill | 206/5 |
| 4,312,449 | 1/1982 | Kinderman | 206/482 |
| 4,667,827 | 5/1987 | Calcerano | 211/59.1 |

FOREIGN PATENT DOCUMENTS

| | | | |
|---|---|---|---|
| 0956370 | 1/1950 | France | 206/479 |
| 1344782 | 10/1963 | France | 206/806 |
| 1492743 | 11/1977 | United Kingdom | 206/466 |

*Primary Examiner*—Jimmy G. Foster
*Attorney, Agent, or Firm*—Foley & Lardner

[57] ABSTRACT

A collapsible display system includes an elongated plastic strip having a series of tabs which hold display items and a series of creases or perforations which can be fan-folded. In loaded and collapsed form, display items may be locked onto the strip and the assembly assumes a manageable shape. When the strip is extended, the items on it are layered, have a somewhat flat profile, and can be reached individually. This collapsible display system improves on previous designs because it can be preloaded, shipped in a compact shape, and readily set up on a store shelf.

19 Claims, 1 Drawing Sheet

COLLAPSIBLE DISPLAY SYSTEM

TECHNICAL FIELD

This invention relates to point-of-purchase display systems, particularly to merchandising strips for product display.

BACKGROUND OF THE INVENTION

Merchandise presentation must satisfy requirements of both retailers and suppliers. Retailers demand displays which will allow normal presentation of products, adapt to existing fixtures, and require minimal installation, e.g., come with the product loaded and ready to sell. Suppliers need a display which can be assembled and shipped with minimal labor, material, and storage requirements.

Conventional merchandising strips in commercial use have a series of tabs or clips onto which items of merchandise are secured. The loaded assembly is hung from price channels, shelves, walls, gondolas, wire racks, or S-hooks by the retailer. Such merchandising systems are sold under the tradenames Safety J-Hooks, Wonderhooks, and Sell Strips. The former includes J-shaped hooks which project horizontally into an aisle from shelving. The curved end of the "J" prevents products from dropping off the horizontal arm unless intentionally removed. This design is inconvenient since products extend outward into aisles and only the first item is easily reached. The Wonderhook, a variation on the J-hook, has a vertically angled design that does not project into the aisle. Items are layered on the hook for better viewing and flatter profile, but the first item is still the most reachable.

A "Sell Strip" is a long, rigid piece of plastic with multiple projections or tabs along its length. Products for display are mounted on these tabs. The loaded assembly, consisting of a rigid strip and products, must be wrapped to retain products on the strip during shipping and storage. The resulting package is large and cumbersome, and the retailer must unwrap the assembly before it can be displayed. However, the flat, layered design of the strip minimizes the amount of retail space used by the display, and allows items to be removed individually by the customer. Metal versions of these strips having clips or jaws to hold products are also in use but are more costly to produce.

Certain products such as lollipops have been sold in long, foldable strips, e.g., a series of individual plastic packages connected end-to-end. The products are displayed end to end and occupy more space than layered products. This kind of packaging system is not useful for many products.

Conventional strip display systems solve some of the problems facing a retailer, but create other problems for both retailer and supplier with shipping, storage, materials, and labor. Strips loaded with products which can nest uniformly, such as batteries or film, are easily secured. However, products of unusual shape or bulk are difficult to package and ship when assembled on strips. Movement readily causes such products to disengage from the strip. Shrink-wrap films or sleeves fastened with rubber bands or tape make the shipping cube manageable, but introduce higher material and labor costs. Unwieldy cubes stack poorly, occupy more space, and increase shipping and storage costs.

Despite the foregoing problems, retailers prefer displays preloaded with products. An entire sub-industry known as "jobbers" has developed to meet this demand. Jobbers buy in bulk, load products on strips, then deliver the loaded strips to retailers. Retailers prefer to buy direct from the manufacturer to eliminate the costs of intermediaries such as jobbers. A display system is needed which can eliminate handling problems by securing and arranging products for shipping and storage in an economical manner.

SUMMARY OF THE INVENTION

A collapsible display system according to the invention includes a flexible strip having widthwise creases or perforations at spaced positions along its length. These creases or perforations are directed alternately in opposite directions so that the strip is fan-foldable. The strip also has suitable structure for allowing a series of items to hang at spaced positions along the strip, for example, a series of spaced holes or projections. According to one embodiment of the invention, a series of projections extend from one side of the strip. Display items hang from each of the projections, generally in overlapping positions, by means of a slot near the upper edge of the item package. As the strip is loaded, it is collapsed into a compact stack by folding at the creases.

BRIEF DESCRIPTION OF THE DRAWINGS

A preferred exemplary embodiment of the invention will be described in conjunction with the appended drawings, wherein like numerals denote like elements, and.

DETAILED DESCRIPTION

Figure 1:
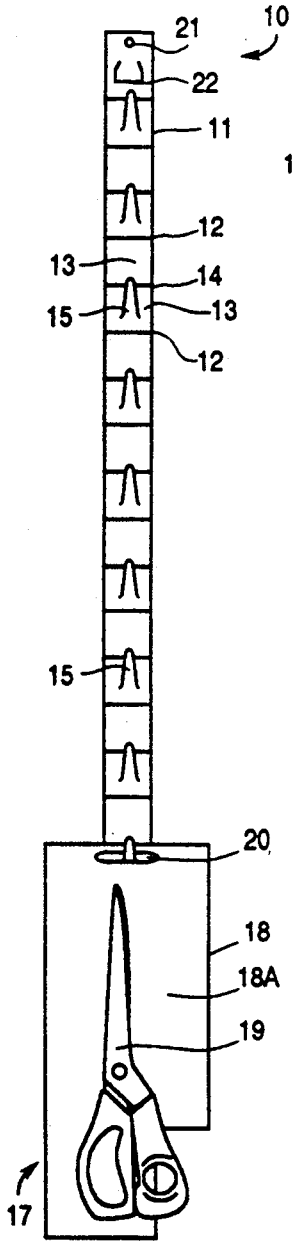
FIG. 1 is a front view of a display system of the invention in extended position with a display item attached.
Figure 3:
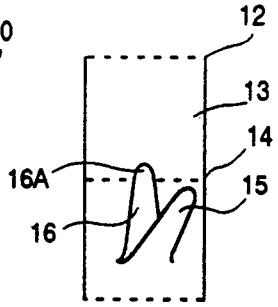
FIG. 3 is an enlarged, partial front view of a collapsible segment of the display system shown in FIG. 1.
Figure 2:
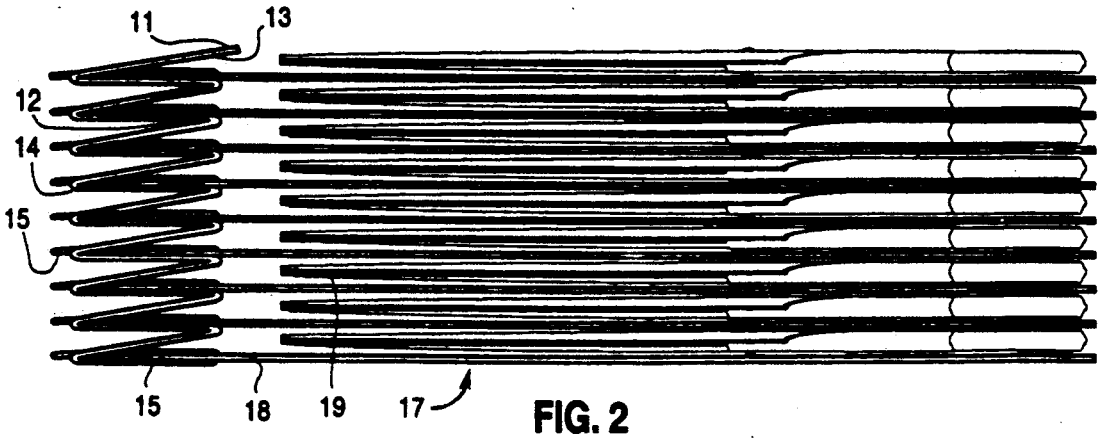
FIG. 2 is a side view of the display system of FIG. 1 in collapsed position and loaded with display items.

Referring to FIGS. 1 to 3, a display system 10 includes an elongated strip 11 holding a plurality of packaged display items 17. Strip 11 is segmented along its length by repetitions of an inward widthwise crease or perforations 12, flat panel 13, outward crease 14 and tab (projection) 15. Widthwise creases 12 and 14 are directed alternately in opposite directions so the strip is fan-foldable. Tabs 15 may be conveniently formed as cut-outs from strip 11. A generally U-shaped, lengthwise slit is made at intervals along strip 11 in the shape of each tab 15. Tab 15 pulls out leaving a hole 16 (see FIG. 3). Hole 16 may extend past crease 14 a short distance so that its narrow end 16A extends onto the next adjacent panel 13. There is one tab 15 for each associated crease or perforation 14, so that there is one tab (or hole, as described below) for every two creases or perforations along the strip. Each tab 15 is preferably identical to and extends in the same direction as all the other tabs 15. There are generally at least 5, usually from 6 to 12 such tabs per strip.

Each display item 17 includes a package 18 having a backing 18A, and an article 19, e.g., a pair of Fiskars® scissors in the embodiment shown loose or secured by any suitable means, such as a plastic wrapper, staple, band or the like. Backing 18A has a slot 20 near its upper edge which engages one of the upwardly-extending tabs 15. Slot 20 is offset from the article 19 so that strip 11 can be folded without interference, as shown in FIG. 2. Suitable means, such as an opening (hole 21 or slit 22) formed in the topmost (endmost) panel 13, can be used to mount strip 11 to a support such as a hook (hole 21) or box (slit 22) attached to a shelf.

Strip 11 is preferably made of a thin, resilient plastic such as mylar, polyethylene, or polypropylene. A die press is used to pierce strip 11 to form hole 21, slit 22, and tabs 15, and to press, perforate or score creases 12 and 14. Simultaneous manufacture of multiple strips may be carried out by setting the die press to cut strips in widthwise or lengthwise arrangement, and perforating between each strip.

The tapered shape of each tab 15 increases its strength and makes loading easier. Efficiency of the fan-fold depends on the spacing between creases. Creases 12, 14 are preferably spaced from each other by a uniform distance typically in the range of 3 to 10 cm. The overall dimensions and strength of strip 11 should be suitable for the size and weight of the products to be displayed. The strip must be strong enough to withstand the force of a product being pulled off, repeated folding, and the weight of the products for an extended period of time. At the same time, it must be flexible enough to assume the compact, fan-folded shape shown in FIG. 2.

Display item 17 is loaded onto strip 11 by means of slot 20 which engages tab 15. The strip is fan-folded as it is loaded at creases 12 and 14. As it collapses, panels 13 fold tabs 15 down and lock items 17 onto the strip (FIG. 2). In this position panels 13 are alternately horizontal (parallel with backing 18*a* ) and angled, so that each segment of strip 11 is Z-shaped. A user can unpack the stack of items shown in FIG. 2 by simply grasping the free upper end of strip 11, lifting the stack, and hanging it in place. When strip 11 is extended, items 17 on it are layered, i.e., overlap each other, have a somewhat flat profile, and can be reached and removed individually.

Figure 6:
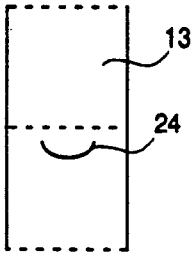
FIG. 6 is an enlarged, partial front view of a collapsible segment according to a further alternative embodiment of the invention.
Figure 4:
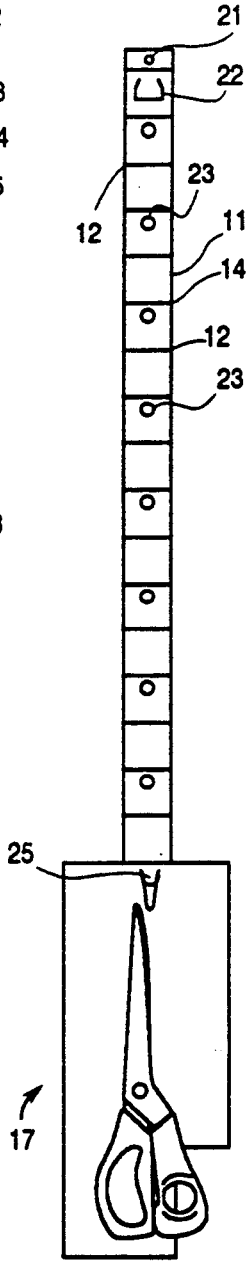
FIG. 4 is a front view of an alternative embodiment of the invention wherein the strip has a series of holes instead of tabs.
Figure 5:
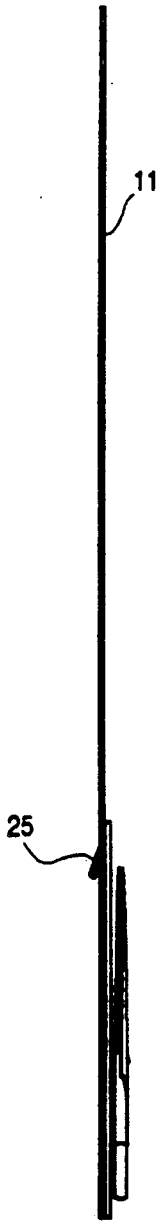
FIG. 5 is a side view of the display system shown in FIG. 4.

FIGS. 4 to 6 illustrate alternative embodiments of the invention which reverse the method of engagement between strip 11 and display item 17. In these embodiments, a series of evenly spaced openings such as holes 23 (FIGS. 4–5) or a series of crescent-shaped slits 24 (FIG. 6) in every other panel 13 replace tabs 15. For maximum convenience, each hole 23 or slit 24 is located near (just below) each crease or perforation 14. Package backing 18 has suitable means, such as a downwardly directed tab 25, which engages each hole 23 or slit 24.

A loaded, collapsed strip according to the invention presents a significantly reduced rectangular or cubic shape advantageous for shipping and storage. The collapsed form prevents display items 17 from slipping off tabs 15. As shown in FIG. 2, panels 13 are alternately horizontal and angled depending on the thickness of items 17. Tabs 15 extend through hole 16 past both associated panels 13 so that the tips of tabs 15 extend past the adjacent crease or perforation 14. Items 17 thus become interlocked with tabs 15 and panels 13. No further means of securing the product is required, eliminating the need for shrink-wrap films or sleeves retained by rubber bands or tape.

Labor at the retail outlet is minimal in that the strip does not need to be unwrapped or loaded and may be hung from existing supports. Providing the strip with both end hole 21 and U-shaped slit 22 provide versatility by allowing the retailer to hang strip 11 with hooks or from boxes. With strip 10 in its extended form, items 17 are unlocked from strip 11 and immediately reachable by customers.

The invention thus improves on previous non-collapsible strip display systems by eliminating the need for extra packaging, providing a more compact shape for shipment, and facilitating unpacking of the display. It should be further understood that the foregoing description is of the preferred exemplary embodiment of the invention, and that the invention is not limited to the specific form shown. Other modifications may be made in the design and arrangement of the elements without departing from the scope of the invention as expressed in the appended claims.

We claim:

1. A collapsible display system, comprising:

an elongated strip having a plurality of widthwise folding means at spaced positions along the length thereof, said folding means being alternately directed in opposite directions so that said strip is fan-foldable;

means for engaging a plurality of display items having ends engageable with the strip;

a plurality of display items mounted on said strip at said engaged ends by said engaging means, said strip and said display items being configured so that said strip when loaded with said display items can be collapsed by folding at said folding means into a compact stack; and said engaging means and said folding means cooperable when said strip is fan-folded to interlock said display items with said strip at said engaged ends.

2. The display system of claim 1, further comprising an opening located near one end of said strip for mounting said strip on a support.

3. The display system of claim 1, wherein said engaging means comprises a series of tabs integral with said strip.

4. The display system of claim 3, wherein said tabs have been formed by making a series of generally U-shaped slits in said strip so that a portion of said strip complementing said slit forms each tab.

5. The display system of claim 3, wherein said display item further comprises a generally flat package containing an article, said package including a flat backing having a slot near one edge thereof which engages said tab.

6. The display system of claim 5, wherein each of said tabs extends past one of said creases or perforations and extends through an associated slit in said strip so that said backing becomes interlocked with said strip when said display system is in a fan-folded position.

7. The display system of claim 3, wherein said strip is made of a thin, flexible plastic or chipboard.

8. The display system of claim 1, wherein said engaging means comprises a series of holes along the length of said strip at positions between adjacent folding means.

9. The display system according to claim 3 or 8, wherein the distance between each of said engaged ends and adjacent folding means is less than the distance needed for each of said display items to disengage said tabs.

10. A thin, elongated, flexible strip for use in a display system displaying a plurality of items having ends engageable with the strip;

said strip having a series of widthwise folding means at spaced positions along its length, said folding means being alternately directed in opposite directions so that said strip is fan-foldable, said strip having means for engaging the plurality of display items at said engaged ends; and said engaging means and said folding means cooperable when said strip is fan-folded to interlock said display items with said strip at said engaged ends.

11. The strip of claim 10, further comprising an opening located near one end of said strip for mounting said strip on a support.

12. The strip of claim 10, wherein said engaging means comprises a series of tabs integral with said strip.

13. The strip of claim 12, wherein said tabs have been formed by making a series of slits in said strip so that a portion of said strip complementing said slit forms each tab.

14. The strip of claim 13, wherein said slits are formed at regular intervals along the length of said strip and from a position slightly spaced from one of said folding means through and interrupting an adjacent, alternately directed folding means.

15. The strip of claim 10, wherein said strip is made of a thin, flexible plastic or clipboard.

16. The display system according to claim 1 or 10, wherein said folding means are creases.

17. The display system according to claim 1 or 10, wherein said folding means are perforations.

18. A collapsible display systems, comprising:

an elongated strip having a plurality of widthwise folding means at spaced positions along the length thereof, said folding means being alternately directed in opposite directions so that said strip is fan-foldable;

a series of tabs integral with said strip for engaging a plurality of display items;

a plurality of display items mounted on said strip by engaging said tabs, said display items being generally flat packages containing articles, each of said packages including a flat backing having a slot near one edge thereof;

said strip and display items being configured so that said strip when loaded with said display items can be collapsed by folding at said folding means into a compact stack; and each of said tabs extending past one of said folding means and extending through an associated slit in said strip so that said backing becomes interlocked with said strip when said display system is in fan-folded position.

19. A thin, elongated, flexible strip for use in a display system, said strip having a series of widthwise folding means at spaced positions along its length, said folding means being alternately directed in opposite directions so that said strip is fan-foldable;

said strip having a series of tabs integral with said strip for engaging a plurality of display items, said tabs being formed by making a series of slits in said strip so that a portion of said strip complementing said slit forms each tab; and said slits being formed at regular intervals along the length of said strip and form a position slightly spaced from one of said folding means through and interrupting an adjacent, alternately directed folding means.

* * * * *

UNITED STATES PATENT AND TRADEMARK OFFICE

CERTIFICATE OF CORRECTION

PATENT NO. : 5,103,970

DATED : April 14, 1992

INVENTOR(S) : Nielson, et al

It is certified that error appears in the above-indentified patent and that said Letters Patent is hereby corrected as shown below:

Column 5, line 1, claim 18, delete "systems" and substitute --system--.

Signed and Sealed this

Twenty-fourth Day of August, 1993

Bruce Lehman

*Attest:*

BRUCE LEHMAN

*Attesting Officer*

*Commissioner of Patents and Trademarks*